US005487924A

United States Patent [19]

Fritze

[11] Patent Number: 5,487,924

[45] Date of Patent: Jan. 30, 1996

[54] NAPKIN RING

[76] Inventor: Dorothy C. Fritze, 6064 Meadowbrook Dr., Morrison, Colo. 80465

[21] Appl. No.: 147,754

[22] Filed: Nov. 5, 1993

Related U.S. Application Data

[63] Continuation-in-part of Ser. No. 10,719, Jul. 15, 1993, Pat. No. D. 353,522.

[51] Int. Cl.[6] ..... A47G 11/00; D04D 7/10

[52] U.S. Cl. ..... 428/5; D7/633; 24/7; 428/136

[58] Field of Search ..... 428/4, 5, 133, 428/136, 7; D7/633; 24/7

[56] References Cited

U.S. PATENT DOCUMENTS

| | | | |
|---|---|---|---|
| 1,053,126 | 2/1913 | Fuller et al. | 428/5 X |
| 3,026,639 | 3/1962 | Lille | 428/5 X |
| 3,063,590 | 11/1962 | Hopkins | 428/5 X |
| 4,467,503 | 8/1984 | Boynton | 428/4 X |
| 4,900,632 | 2/1990 | McGrath | 428/5 X |
| 5,240,750 | 8/1993 | Cheng | 428/5 |

*Primary Examiner*—Henry F. Epstein
*Attorney, Agent, or Firm*—Timothy J. Martin

[57] ABSTRACT

A napkin ring that receives a napkin is formed as an elongated strip of flexible material with head portions on the opposite ends thereof. Slots are provided, either in the strip, in the head portions or at the juncture therebetween so that the strip may be configured in a loop that is retained in a fastened state by the mated engagement of the slots so that the loop may encompass a napkin. When fastened in the loop, the head portions are located adjacent one another and together provide a flat exposed viewing surfaces with a portion thereof on each head portion. The head portions are provided with distinct design elements such that, in the fastened state, a coordinate theme is presented. The head portions together can form a single object or distinct objects that together create a uniform theme. The slots may extend from opposite lateral sides of the strip or from a common side. If desired, the slots can have enlarged mouths, and the head portions can be enlarged.

21 Claims, 4 Drawing Sheets

NAPKIN RING

This is a Continuation-in-Part of a Design Patent Application having Ser. No. 010,719, now U.S. Pat. No. D 353,522 which was filed in the U.S. Patent Office on Jul. 15, 1993.

FIELD OF INVENTION

The present invention generally relates to novelty decorations such as decorations of a type usually used at social events, business gatherings or on other such occasions where food and/or beverages might be served. The field of the present invention specifically concerns decorative napkin rings which encircle a napkin for presentation.

BACKGROUND OF THE INVENTION

Social interactions, whether for business or pleasure, comprise a significant part of human relationships, and historically all civilizations have utilized social gatherings, both formal and informal, as a method of political organization, business conduct, religious celebration, celebration of events or simply for entertainment. These and other such events may for simplicity be referred to as "social affairs". Modern society, of course, has evolved so that a wide variety of different occasions result in such social affairs, and a good host is one able to create a memorable and enjoyable event for his/her guests. Accordingly, a host often selects a distinctive theme for social affairs, and, indeed, many social affairs are theme oriented by the very nature of the event since it is the event which gives rise to the social affair.

The theme for any such a social affair can be displayed through the decorations and appointments implemented by those in charge of administering the affair. At a formal party, for example, china and crystal are used as place settings, and the theme of the party is shown through place cards, table cloths, napkins and, perhaps, a centerpiece on the table. Less formal parties may employ paper products wherein a theme may be uniformly presented through designs placed on table coverings, plates, cups and napkins. A simple business meeting or other event where a food or beverage refreshment is offered, may provide only a disposable napkin or the like. For all such social affairs, formal or informal, it may be desirable to display a theme, logo or other decoration as part of the appointments.

Even in the context of an informal event, the host may seek to "dress-up" table settings by presenting either a decorated napkin or a plain napkin in a more formal format by use of a napkin ring. Such napkin rings, of course, are used to encircle a napkin to hold the napkin in a stored configuration. The ability of a napkin ring to carry on the theme of the affair or otherwise be specially correlated through the decorations to such theme, is therefore desirable. However, heretofore, the provision of an interlocking structure for a napkin ring, especially one with an integrated design theme, has not been known.

SUMMARY OF INVENTION

An object of the present invention is to provide a new and useful napkin ring which makes a decorative statement for social affairs.

Another object of the present invention is to provide an inexpensive napkin ring which may be disposable, if desired.

A further object of the present invention is to provide a napkin ring which, when used, presents a pleasant decorative design which may be viewed by guests or attendees at a social affair.

Still a further object of the present invention is to provide a napkin ring in the form of an interlocking, releasable tie which, when fastened, utilizes head pieces which register with one another to create a decorative and/or design theme.

Another object of the present invention is to provide a napkin ring that can be fastened and unfastened about a napkin and that presents a theme in both states.

According to the present invention, then, a napkin ring is provided in the form of a releasable tie which is adapted to encircle a napkin and be fastened to retain a napkin in a stored configuration. Broadly, the napkin ring includes an elongated strip of flexible material. This strip has opposite ends, a pair of lateral side edges extending longitudinally between the ends and a front and back surface. A head portion is disposed at each opposite end of the strip, and a slot structure is located proximate to each one of the head portions. These slots are sized and adapted to cooperate with one another so that they matably engage when the strip is configured into a closed loop so that the loop may be held in a fastened state to encompass a napkin with the head portions located adjacent to one another.

Preferably, the strip and the head portions are formed as an integral one-piece construction of a material such as paper, paper board, metal foil, plastic and fabric. Furthermore, it is desirable that the head portions have a greater width than the strip width as measured between the lateral side edges. The slots may be formed either in the strip, in the respective head portions, or at the junction locations between the ends of the strip and the head portions. In any event, the slots may be formed on the same side of the strip, but are preferably formed on opposite sides so that, when the strip is formed into a loop, these slots may have open mouths that face one another so that they may be engaged. To this end, each slot extends transversely of the longitudinal extension of the strip and preferably extends at least fifty percent (50%) of the distance across the strip width.

In any event, the head portions are adjacent to one another to present an exposed viewing surface when the strip is in the fastened state. This exposed viewing surface is then provided with a decorative design. Here, a first part of the decorated design is disposed on a first one of the head portions and a second part of the decorative design is disposed on the second one of the head portions. The first and second parts of the decorative design maybe positioned to register with one another when the head portions are adjacent in the fastened state. Furthermore, the head portions may be configured to have a perimeter of a selected shape such that the perimeters form a continuous outline of an object when the head portions are adjacent and in the fastened state. For example, the object may be one selected from a group consisting of butterfly, a flower bouquet, a gift box and the like. Alternatively, each of the head portions may be provided with distinct design elements such that, when the head portions are adjacent to one another in the fastened state, the design elements create a coordinated theme, such as a verbal message or artistic depiction.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

Figure 1:
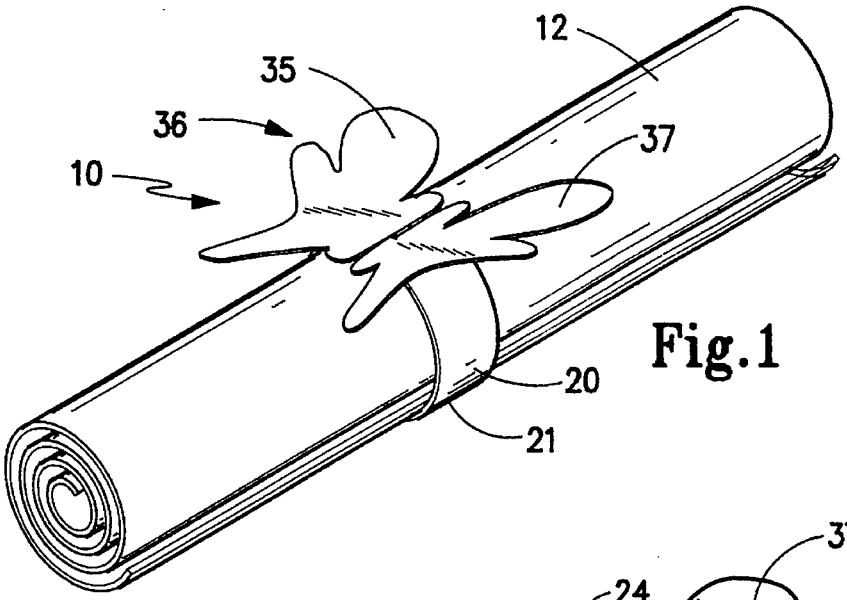
FIG. 1 is a perspective view of a napkin ring according to a first exemplary embodiment of the present invention shown encircling a napkin.

The present invention generally relates to novelty decorations, but particularly relates to table decorations for various social affairs. The present invention specifically concerns decorative napkin rings which display a decorative design while encircling the napkin on a table. In its broad form, this invention includes an elongated body member in the form of a strip that has opposite ends and that is formed of a thin flexible material. Each opposite end of the strip has a head portion disposed thereon, and a pair of cooperating spaced-apart slots are provided to permit the elongated strip to be fastened into a loop-shaped structure adapted to encircle a napkin when the slots are engaged.

By way of illustration, a first exemplary embodiment of the present invention is shown in FIGS. 1–4. In these Figures, it may be seen that a napkin 12 is encircled by the napkin ring 10. Napkin ring 10 includes an elongated strip 20 that has opposite ends 22 and 24. Head portions 35 and 37 are respectively disposed at each opposite end 22 and 24 of the strip 20. Here, head portions 35 and 37 are configured in the shape of a wing and a portion of the body of a butterfly 36. It should be understood that the head portions 35, 37 can be formed in a variety of different shapes and can have a variety of designs thereon. The configuration and design of the head portions of the present invention are virtually unlimited, and to this end as more thoroughly described below, the napkin ring can be constructed according to the exemplary embodiments of the present invention so that the head portions of the napkin ring are customized for the theme which is appropriate for the selected social affair.

Figure 2:
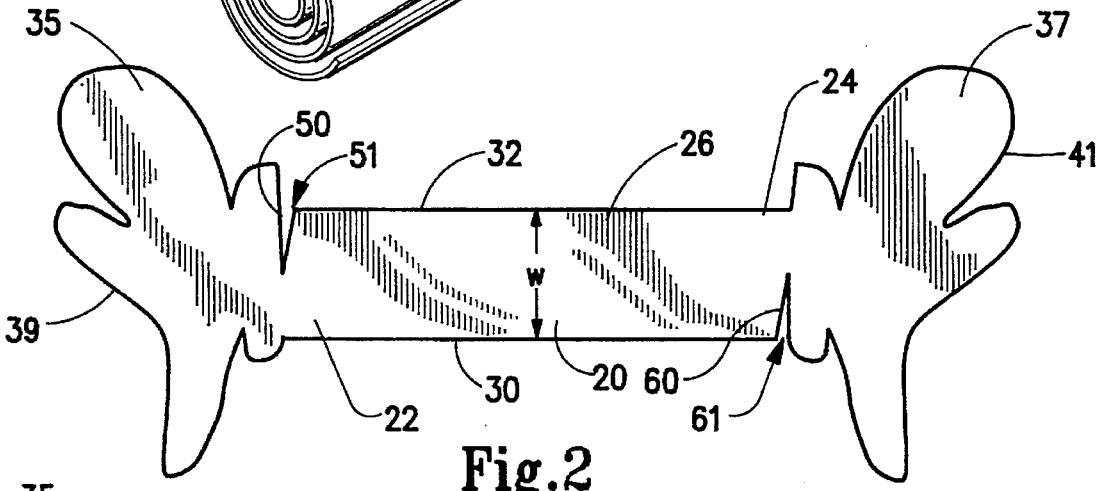
FIG. 2 is a front view in elevation of the napkin ring of FIG. 1 in an unfastened state.
Figure 3:
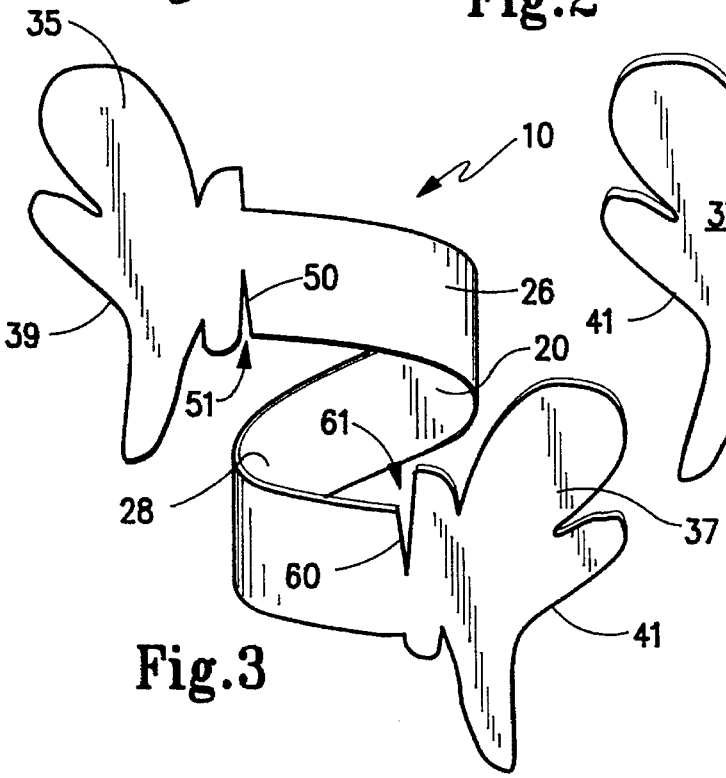
FIG. 3 is a front perspective view of the napkin ring of FIG. 1 showing the napkin ring just prior to into engagement of the slots into the fastened state.
Figure 4:
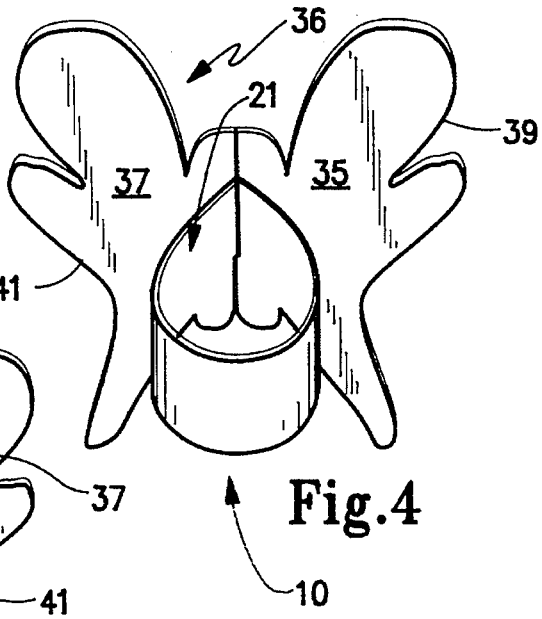
FIG. 4 is a rear perspective view of the napkin ring of FIG. 1 in the fastened state.

With further particularity, as is shown in FIGS. 2–4, the strip 20 has a front surface 26 and a rear surface 28. A first lateral side edge 30 and a second lateral side edge 32 extend between head portions 35 and 37 and define a width "w" therebetween. Lateral edges 30 and 32 thus extend longitudinally of strip 20. In the preferred embodiment of the present invention, strip 20 is formed of a thin flexible material, such as a paper product. Alternatively, strip 20 can be formed of metallic foil, paper board, plastic or a fabric material. Selection of the type of flexible material would be in the range of skills of the ordinarily skilled person in this field having read the disclosure of this invention.

Turning specifically to FIGS. 2 and 3 it may be seen that each of the pair of head portions 35, 37 are configured to have a perimeter 39, 41 respectively of a selected shape, in this instance the wing of the butterfly 36. The perimeters 39, 41 of the head portions 35, 37 when in the unfastened stated show an incomplete representation of the object. Each of the head portions 35, 37 only show a representative one-half of a swallow-tailed butterfly 36 (shown in FIGS. 1 and 4. When the pair of head portions 35, 37 are adjacent to one another in the fastened position such as can be seen in FIGS. 1 and 4, then, the separate outlines formed by the perimeters 39, 41 register together to form a continuous outline of an object, in this instance the butterfly 36.

The napkin ring 10 has an unfastened state such as shown in FIG. 2 and a fastened state such as shown in FIG. 4. Turning to FIGS. 2 and 3, it can be seen that the napkin ring 10 has a pair of spaced-apart slots 50 and 60 which are sized and adapted for into engagement with one another so that the napkin ring 10 can be placed in the fastened state. The slots 50, 60 slidingly and releasably engage one another in the fastened state, whereby the pair of head portions 35 and 37 can be located adjacent to one another in a fastened state. Each of the slots are located proximate to a respective one of the head portions 35, 37. When the head portions 35, 37 are located proximate one another with the slots 50, 60 engaged, the elongated strip 20 forms an enclosed loop structure 21. This loop 21 is adapted to encircle the napkin 12 in a stored position for presentation as part of a place setting, for example.

In the preferred embodiment of the present invention, the slot 50 is formed through the first lateral side edge 30 and has an enlarged mouth 51. Similarly, slot 60 is formed through the opposite second lateral side edge 32 and has an enlarged mouth 61. The slots 50 and 60 respectively extend transversely a distance at least fifty percent (50%) of the width "w" which is defined by the first lateral side 30 and the second lateral side edge 32. Thus, the opposite ends 22, 24 are approximate one another at the juncture of the slots 50, 60 when the napkin ring is in the fastened state. Furthermore, the first lateral side edge 30 and the second lateral edge 32 when in the fastened state form continuous upper and lower perimeters of loop 21.

As is shown in FIG. 1, when the slots 50 and 60 are matably engaged one to another in the fastened state, the pair of head portions 35 and 37 form a substantially flat outwardly projecting viewing surface 75. The head portions 35 and 37 which are formed as butterfly wings provide an enlarged viewing surface relative to the width of the strip 20. The pair of head portions 35 and 37 each may include a design, which can be painted, imprinted, glued, drawn or otherwise disposed thereon. The means for placing designs on the paper, foil fabric and plastic material are well known, and methods other then those listed could be employed within the scope of the present invention.

Regardless of how the designs are placed on the head portions, the designs are adapted to register with one another to form a uniform design theme. Similar to the configuration of the perimeters 39, 41 of the head portions 35, 37, the designs on the head portions 35, 37 can also each be complete discrete representation of an object or each can be an incomplete representation of an object which only forms a complete uniform design theme when the pair of head portions 35, 37 are adjacent one another. Many of the exemplary embodiments described below clearly show the head portions formed as either a complete or the incomplete design.

Figure 5:
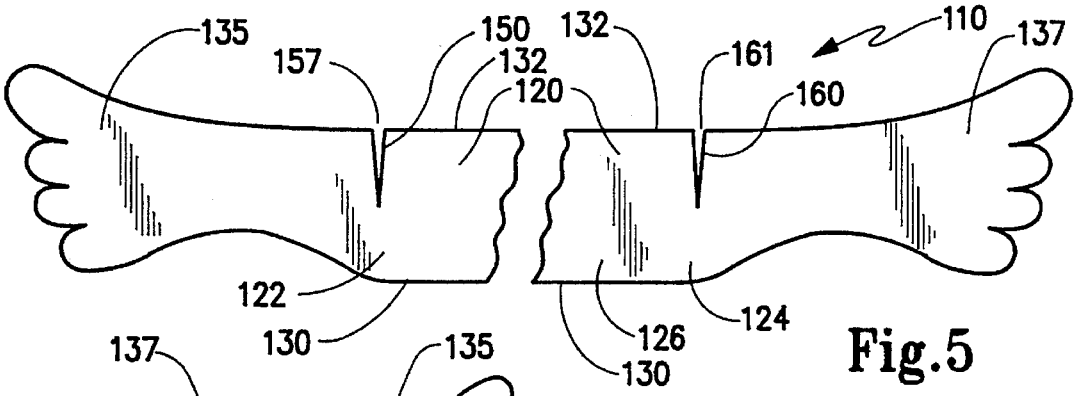
FIG. 5 is a front view in elevation of the second exemplary embodiment of the present invention.
Figure 6:
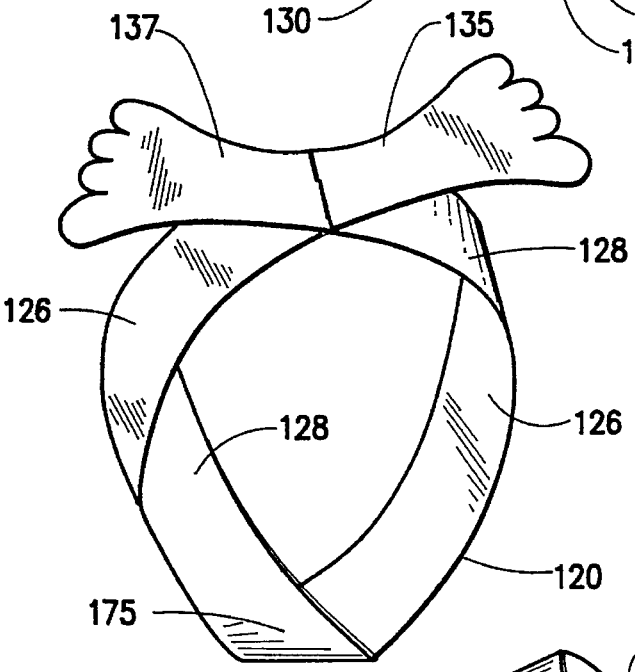
FIG. 6 is a rear perspective view of the napkin ring of FIG. 5 when in the fastened state.

Turning to FIGS. 5 and 6 it may be seen that the second alternative exemplary embodiment of napkin ring 110 has strip 120 with a first surface 126, a second surface 128, opposite ends 122, 124, a first lateral side edge 130 and a second lateral edge 132 defining a width therebetween. Head portions 135 and 137 are located on ends 122, 124, respectively. In this second exemplary embodiment of the present invention, slots 150, 160 respectively, are formed in the same lateral side edge, such as lateral side edge 132. The slots 150, 160 have enlarged mouths 151 and 161, respectively, and can be engaged with one another by twisting strip 20 to form twist 175 such that the first lateral side edge 130 does not match up with the opposite end of the first lateral side edge 130 at the point of the slots 150, 160. Instead, the first lateral side edge 130 registers with the second lateral side edge 132 to form the open sleeve or loop structure.

Figure 8:
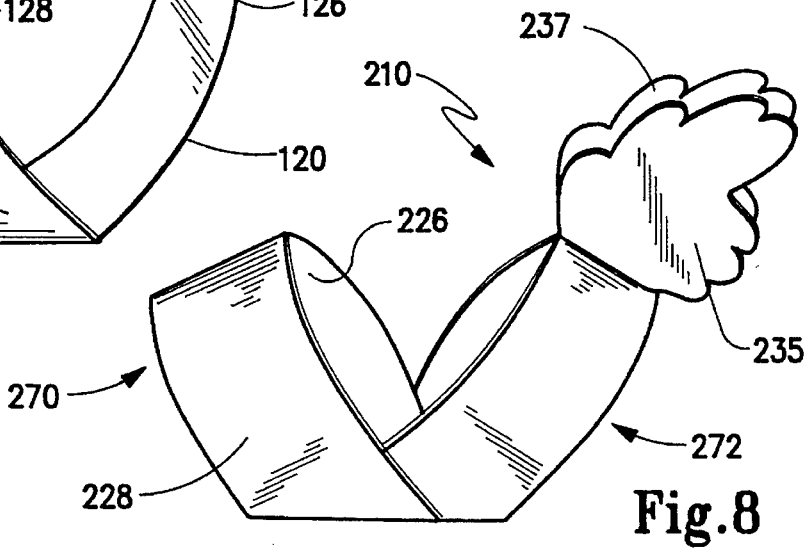
FIG. 8 is a side perspective view of the napkin ring according to the third exemplary embodiment shown in FIG. 7.
Figure 7:
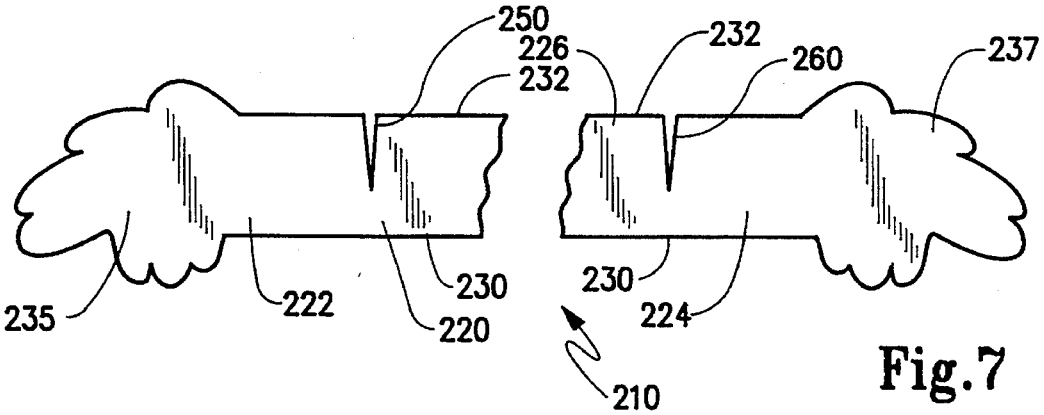
FIG. 7 is a front view in elevation of the third exemplary embodiment of the napkin ring having an extended elongated strip.

Turning to FIGS. 7 and 8, it may be seen that the third alterative exemplary embodiment, napkin ring 210, has a strip 220 with a first surface 226 a second surface 228, opposite ends 222, 224 respectively and a first lateral side edge 230 and a second lateral side edge 232. As can be readily seen, strip 220 is dimensioned longer than strips 20 and 120 discussed above so that this additional length permits the strip 220 to be wrapped around the napkin more than one time to form a pair of loops 270 and 272. When slots 250, 260 are in the fastened state as shown in FIG. 8, the extended strip 220 allows viewing of a portion of strip 220 along with displaying the respective head portions 235 and 237. The third exemplary embodiment permits not only the head portions 235, 237 to display a design theme but also allows one of the first or second body surfaces 226 or 228 to reflect further designs which can correlate or interrelate with the designs on the respective head portions 235 and 237. Here, also, slots 250 and 260 are formed through a common lateral edge 250 of strip 220 rather than at the junctions of the strip 220 and head portions 235 and 237.

Figure 9:
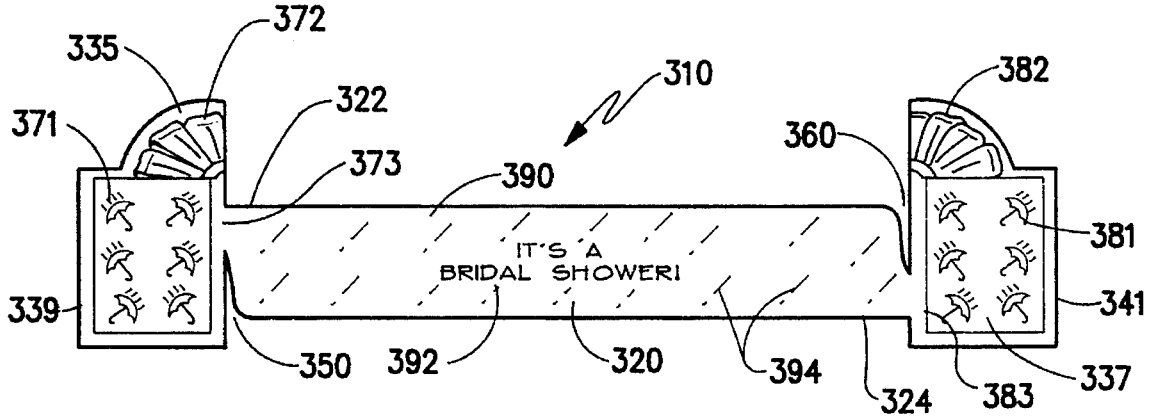
FIG. 9 is a front view in elevation of the fourth exemplary embodiment of the napkin ring showing the head portions formed as a present or gift and the strip having an integrated design.
Figure 10:
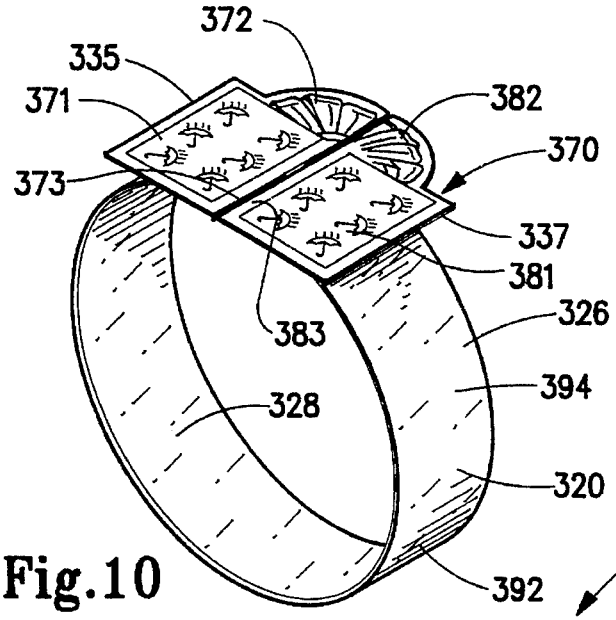
FIG. 10 is a perspective view of the napkin ring of FIG. 9 in a fastened state.

The various exemplary embodiments shown in FIGS. 9 through 15 clearly show that the head portions of the respective napkin rings can be formed in a variety of configurations and having a variety of designs imposed thereon in accordance with the type of celebration for which the decorative napkin ring is employed. FIGS. 9 and 10 show a fourth exemplary embodiment of a napkin ring 310 which, like the previous exemplary embodiments, has a strip 320 with respective ends 322, 324 on which are disposed the respective head portions 335, 337. Proximate to the head portions 335, 337 are the slots 350, 360. The respective head portions 335, 337 are each incomplete representations of a gift box 370. More specifically, head portion 335 has an outline in the form of a gift box part 371, a bow part 372 and a ribbon part 373 depicted thereon. Head portion 337 has an outline in the form of a gift box part 381, a bow part 382 and a ribbon part 383 depicted thereon. When the respective slots 350 and 360 are matably engaged one with another, the uniform design theme of a gift box 370 formed by box parts 371 and 381, that is, perimeters 339, 341 of the respective head portions 335, 337 register in the fastened position to form a continuous outline of the gift box 370. Furthermore, it may be seen that bow parts 372 and 382 along with ribbon parts 373 and 383 register with one another to create the continuous theme of a wrapped gift.

Additionally, the elongated strip 320 has a strip design 390 which includes a written message 392 surrounded by raindrops 394. The raindrops 394 carry the shower design theme across the strip 320 to the head portion 335, 337 where umbrellas are depicted on the wrapping of the gift box 370. The design 390 can be formed either on the first surface 326 or the second surface 328 or alternatively on both surfaces so the design 390 can be viewed when the napkin ring is in either the fastened state or the unfastened state.

Figure 11:
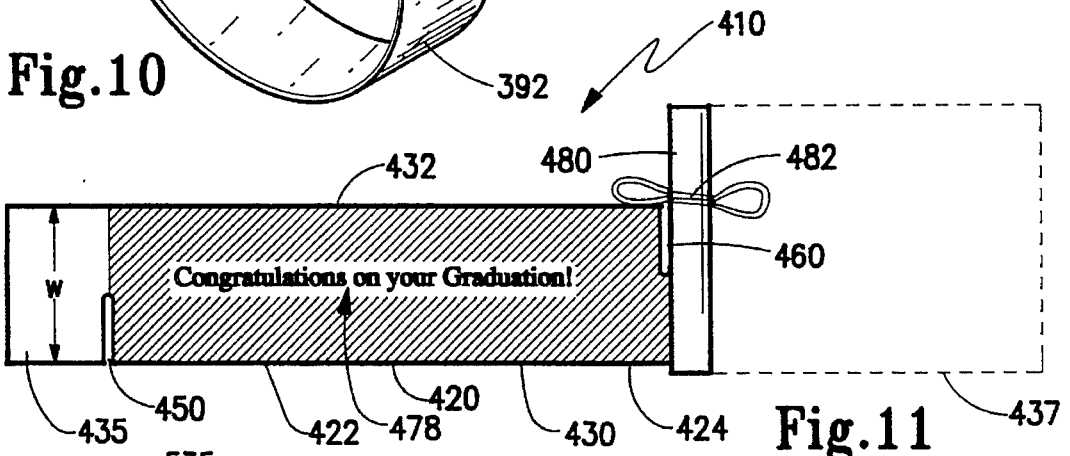
FIG. 11 is a front view in elevation of the fifth exemplary embodiment of the present invention, showing one enlarged head disposed thereon.

FIG. 11 shows the fifth exemplary embodiment of the present invention. A napkin ring 410 has an elongated strip 420 which has head portions 435, 437 disposed on ends 422, 424 respectively, and slots 450 and 460 are provided to releasably secure the napkin ring 410 in the fastened state. Head portion 437, as is shown in phantom, is enlarged relative to the width "w" between the first lateral side edge 430 and the second lateral side edge 432. The other respective head portion 435 is approximately the same width as the strip 420. The enlarged head portion is adapted to be scrolled and tied with a ribbon 482 to form a miniature diploma 480, as is shown in FIG. 11, so that it will be positioned on top of the fastened napkin ring 410. Napkin ring 410 contains a message 478 on the strip surface which is in contact with the napkin 12 such that the message 478 can only be read when the napkin ring is in the unfastened state and the napkin is removed from contact with the message 478.

Figure 12:
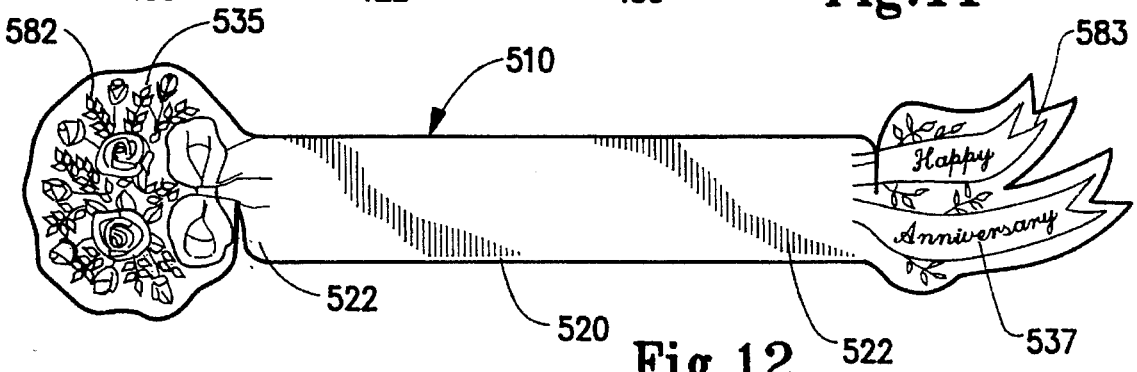
FIG. 12 is a front view in elevation of the sixth exemplary embodiment of the present invention showing the separate head portions which form a flower bouquet.

FIG. 12 shows a sixth exemplary embodiment. A napkin ring 510 with the strip 520 having opposite ends 522 and 524 and head portions 535 and 537 respectively disposed thereon. These head portions 535, 537 are slightly enlarged relative to the width of the strip 520. Head portion 535 has a flower design 582 printed thereon, and head portion 537 has a bouquet ribbon 583 such that when in the fastened state a complete flower bouquet is projected by the viewing surface.

Figure 13:
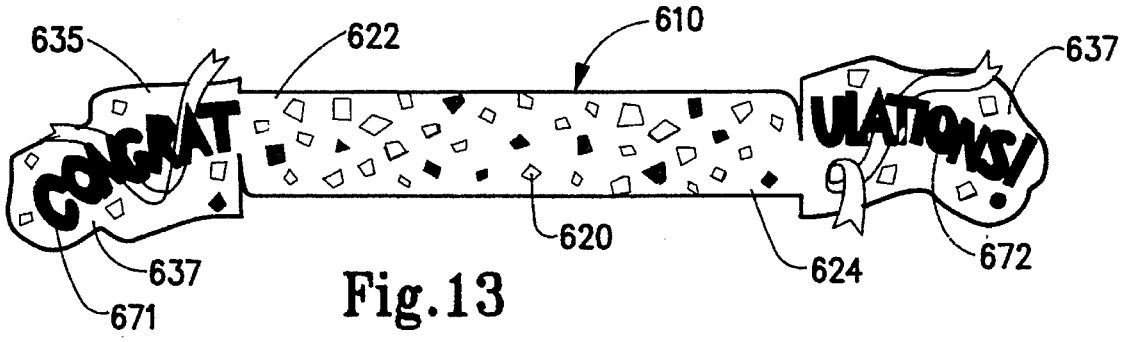
FIG. 13 is a front view in elevation of the seventh exemplary embodiment of the present invention showing a portion of the congratulations decoration disposed on each head portion.

FIG. 13 is the seventh exemplary embodiment. A napkin ring 610 has a strip 620 with head portions 635 and 637 disposed on respective end portions 622 and 624. It should be noted neither of these head portions is significantly enlarged relative to the strip 620. To form the uniform continuous design theme in the form of the word "congratulations", the head portions must be placed in the fastened state such that word parts 671 and 672 register.

Figure 14:
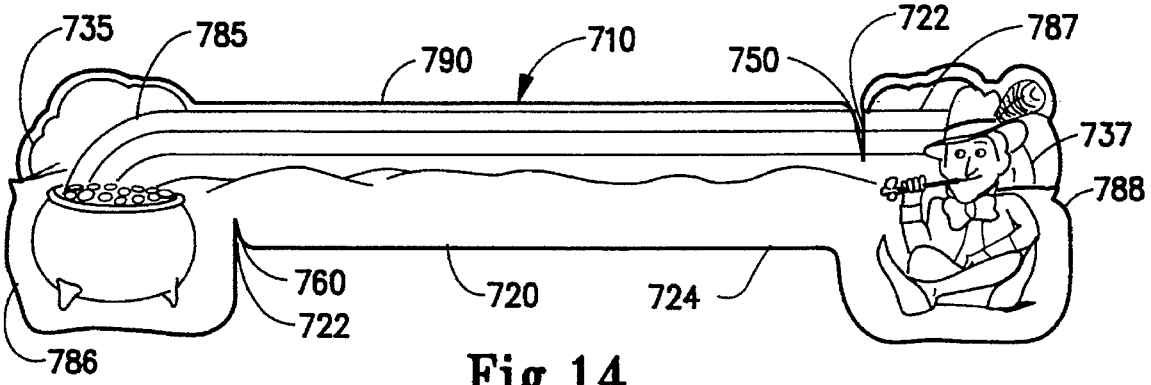
FIG. 14 is a front view in elevation of the eighth exemplary embodiment of the napkin ring showing a pot of gold and a leprechaun.

FIG. 14 shows the eighth exemplary embodiment having napkin ring 710 with strip 720 having respective head portions 735 and 737 disposed on strip ends 722 and 724 respectively. Head portion 735 has a partial rainbow 785 and a pot of gold 786. Head portion 737 has a partial rainbow 787 and a leprechaun 788. This type of decorative napkin ring 710, of course, is appropriate for St. Patrick's Day holiday celebration. Each of the designs on pair of head portions can be considered complete, discrete representations of an object, that is, a pot a gold on one hand and second a leprechaun on the other; yet, when the respective slots 750 and 760 engage one another, a different uniform design theme is depicted on the viewing surface. This different design theme is the typical pot of gold at the end of the rainbow. To this end also, strip 720 has a continuous rainbow 790 extending between rainbow portions 785 and 787.

Figure 15:
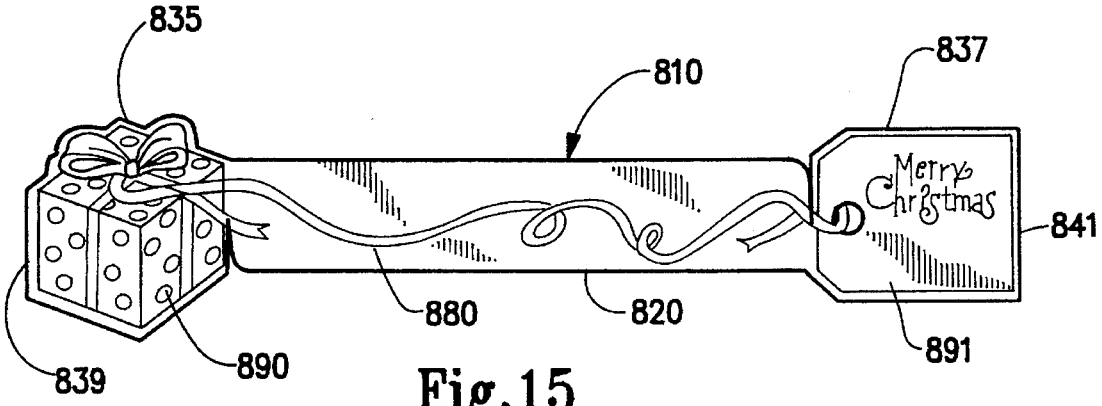
FIG. 15 shows a front view in elevation of the ninth exemplary embodiment of a napkin ring showing a wrapped Christmas present on one head portion and a gift tag on the other head portion.

FIG. 15 shows a ninth exemplary embodiment of the present invention, a napkin ring 810 having a strip 820 with head portions 835 and 837. Each head portion 835 and 837 respectively has a outer perimeter 839 and 841 which are configured to show a selective shape. One shape being a gift package 890, the other shape being a gift tag 891. Likewise the design on each of the pair of respective heads of 835 and 837 are a complete discrete representations of an single object, one object being the gift package 890 and the other object being the gift tag 891, joined by a ribbon 880 on strip 820. When in the fastened state, the correlated image is a gift box with tag.

Figure 16:
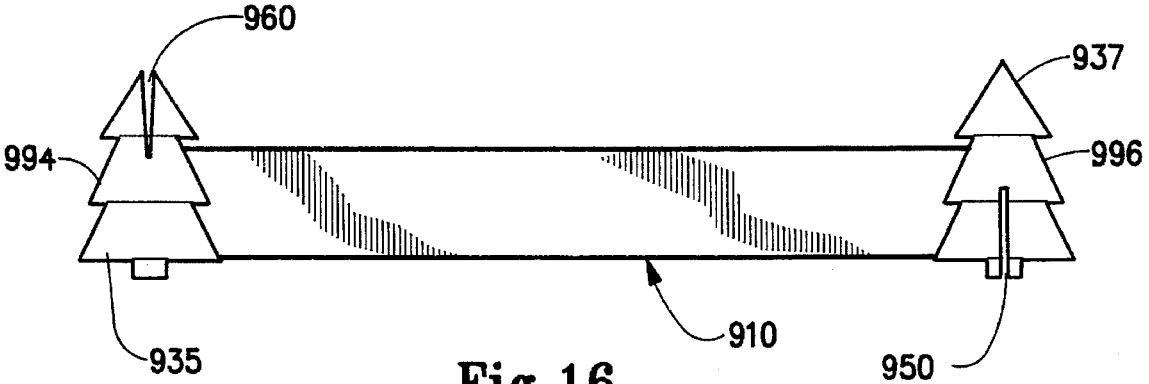
FIG. 16 shows a front view in elevation of the tenth exemplary embodiment of the napkin ring having Christmas trees with slots disposed thereon on either head portion.

FIG. 16 shows a tenth exemplary embodiment of the present invention. Here, the slots 950, 960 are located within the head portions 935, 937, respectively, of napkin ring 910. The head portions 935, 937 are formed such that when the respective slots 950, 960 register one with another to place the napkin ring 910 in the fastened state, a complete Christmas tree may be seen. Likewise when napkin ring 910 is in the unfastened state, two complete Christmas trees 994, 996 are also visible.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A napkin ring adapted to receive a napkin, comprising:

(a) an elongated strip formed of a flexible material, said strip having opposite ends, a pair of lateral side edges extending longitudinally between said ends to define a strip width therebetween, a front surface and a back surface;

(b) a head portion disposed at each opposite end of said strip; and (c) a pair of cooperating, spaced-apart slots, each of said slots located proximate to a respective one of said head portions, said slots sized and adapted for matable engagement with one another when said strip is configured into a closed loop, said loop to encompass a napkin with said pair of head portions located adjacent to one another in a fastened state, each of said pair of head portions configured to have a perimeter of a selected shape such that said perimeters when said head portions are in the fastened state form a continuous outline of an object.

2. A napkin ring according to claim 1 wherein said object is selected from a group consisting of a butterfly, a flower bouquet and a present.

3. A napkin ring adapted to hold a napkin, said napkin ring comprising:

(a) an elongated strip formed of a thin flexible material, said strip having opposite ends, opposite first and second surfaces and opposite lateral side edges defining a width therebetween;

(b) a head portion disposed at each opposite end of said strip, each of said head portions connected at opposite ends of said strip having a decorative design thereon, wherein said pair of head portions form a flat exposed viewing surface provided with a decorative design formed of distinctive design elements when in the fastened state with a loop receiving said napkin with a first part of said decorative design disposed on a first one of said head portions and with a second part of said decorative design disposed on a second one of said head portions, said first and second parts positioned to register with one another when said head portions are adjacent in the fastened state such that, when said head portions are adjacent to one another in the fastened state, said design elements create a coordinated theme; and (c) a pair of cooperating, spaced-apart slots, each said slot located proximate to a respective one of said head portions, said strip adapted to be configured and fastened into a loop sized to encircle a napkin with said pair of head portion adjacent one another, said slots sized and adapted to matably engage one another thereby to retain said strip in a fastened state, said designs on said head portions being correlated with one another to form a uniformly continuous design theme.

4. A napkin ring according to claim 1 wherein said pair of head portions have a greater head width than the strip width of strip.

5. A napkin ring according to claim 3 wherein the coordinated theme is a verbal message.

6. A napkin ring according to claim 3 wherein each of said slots is formed in said strip.

7. A napkin ring according to claim 6 wherein said slots are formed through a common lateral side edge.

8. A napkin ring according to claim 6 wherein said slots are each formed through a different one of said lateral side edges.

9. A napkin ring according to claim 6 wherein each of said slots extend across at least fifty percent of the strip width.

10. A napkin ring according to claim 3 wherein each of said slots is formed in a respective one of said head portions.

11. A napkin ring according to claim 3 wherein each of said slots are formed at a junction of a respective one of said head portions and a respective one of said ends.

12. A napkin ring according to claim 3 wherein each of said slots has an enlarged mouth.

13. A napkin ring according to claim 3 wherein said strip and said head portions are of integral one-piece construction of a common material.

14. A napkin ring according to claim 13 wherein said common material is selected from the group consisting of paper, paper board, metal foil, fabric and plastic.

15. A napkin ring according to claim 3 wherein the pair of designs on each of said pair of head portions are complete, discrete representations of an object.

16. A napkin ring according to claim 3 wherein the designs on each of said pair of head portions are a partial representation of an object such that, when in the fastened state, the designs register with one another to create a uniform design theme.

17. A napkin ring according to claim 16 wherein each of said head portions is configured to have a perimeter of a selected shape such that said perimeters when in the fastened state register together to form a continuous outline of an object.

18. A napkin ring according to claim 17 wherein said continuous outline of an object and said design on each of said head portions register together to depict an uniformly continuous design theme when said head portions are adjacent one another.

19. A napkin ring according to claim 3 wherein said strip includes a strip design on one of the first and second surfaces which strip design is correlated to at least one design on one of said head portions.

20. A napkin ring according to claim 3 wherein one of said head portions is enlarged relative to the other of said head portions.

21. A napkin ring adapted to receive a napkin, comprising:

(a) an elongated strip formed of a flexible material, said strip having opposite ends, a pair of lateral side edges extending longitudinally between said ends to define a strip width therebetween, a front surface and a back surface;

(b) a head portion disposed at each opposite end of said strip, said strip and said head portion being of integral one-piece construction of a common material; and (c) a pair of cooperating, spaced-apart slots, each of said slots having an enlarged mouth and being located proximate to a respective one of said head portions, said slots sized and adapted for matable engagement with one another when said strip is configured into a closed loop, said loop operative to encompass a napkin ring with said pair of head portions located adjacent to one another in a fastened state.

* * * * *